US005992620A

United States Patent [19]

Holtom

[11] Patent Number: 5,992,620

[45] Date of Patent: Nov. 30, 1999

[54] ACCIDENT REPORT KIT

[76] Inventor: Ronald P. Holtom, 7, Farnes Dr., Gidea Park, Romford, United Kingdom, RM2 6N5

[21] Appl. No.: 09/174,347

[22] Filed: Oct. 15, 1998

[51] Int. Cl.[6] ..... B65D 69/00

[52] U.S. Cl. ..... 206/232; 206/214; 206/215; 206/573; 206/578

[58] Field of Search ..... 206/214, 215, 206/232, 224, 371, 472, 573, 578; 312/231; 190/109, 111, 900, 901, 902

[56] References Cited

U.S. PATENT DOCUMENTS

| | | | |
|---|---|---|---|
| 1,314,915 | 9/1919 | Trullench | 206/224 |
| 1,491,807 | 4/1924 | McLinn | 190/109 X |
| 1,666,878 | 4/1928 | Johnson | 190/900 X |
| 1,699,971 | 1/1929 | Johnson | 190/902 X |
| 1,704,040 | 3/1929 | Fingerman | 190/109 X |
| 2,850,296 | 9/1958 | Ratliff | 220/527 |
| 3,977,744 | 8/1976 | DeWitt | 206/214 X |
| 4,483,427 | 11/1984 | Gerch | 190/900 X |
| 5,421,460 | 6/1995 | Bosshard | 206/573 |
| 5,794,676 | 8/1998 | Shattuck | 206/214 X |

*Primary Examiner*—Bryon P. Gehman

[57] ABSTRACT

An accident report kit for providing accessories that may be used to record the details of a traffic accident in a single case. The accident report kit includes a carrying case with a main portion and a tray portion. The main portion of the carrying case has spaced apart front and back walls, a bottom wall, and a pair of spaced apart side walls. The main portion has a top edge along the front, back and side walls defining a top opening into the main portion. The carrying case has a top flap substantially covering the top opening of the main portion. The main portion of the carrying case has a plurality of generally rectangular divider panels therein forming a plurality of compartments. The tray portion of the carrying case has a back panel and a perimeter lip extending around the back panel of the tray portion to define a tray space therein. The perimeter lip of the tray portion is pivotally coupled to the back wall of the main portion adjacent a side wall of the main portion.

19 Claims, 2 Drawing Sheets

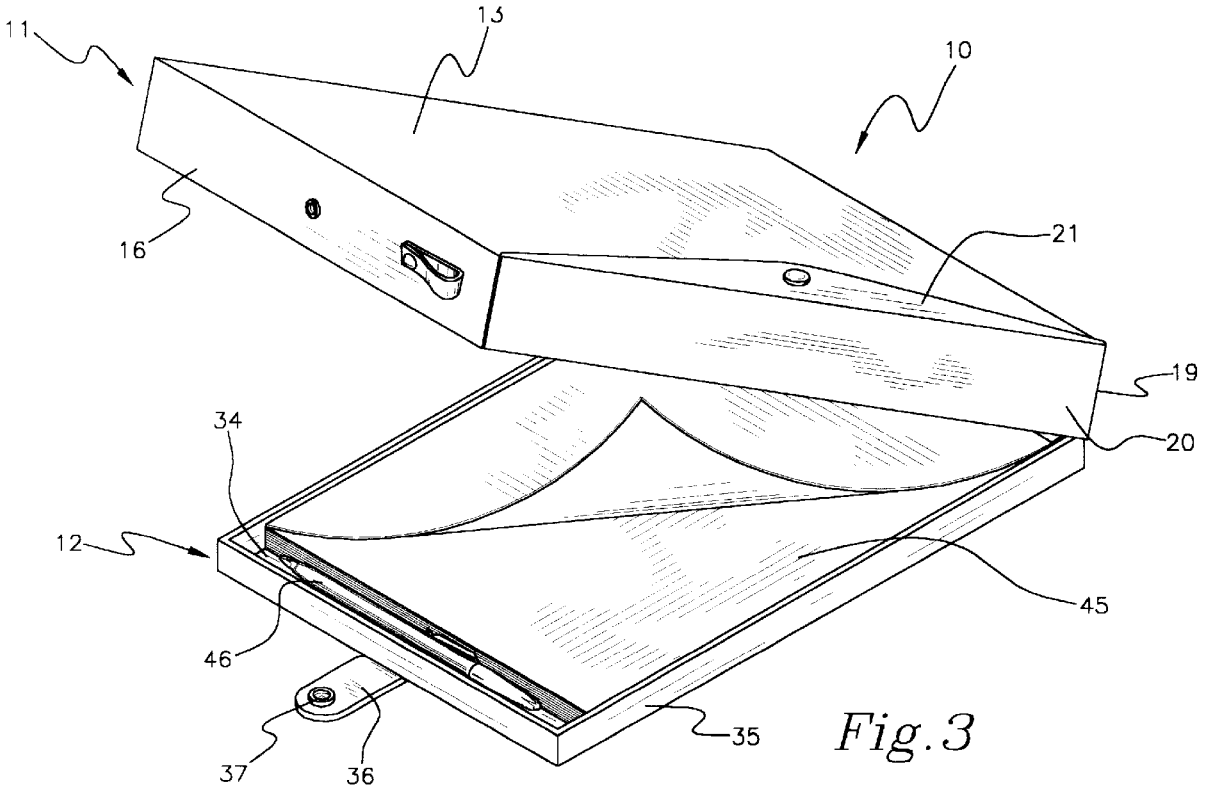

Fig. 3

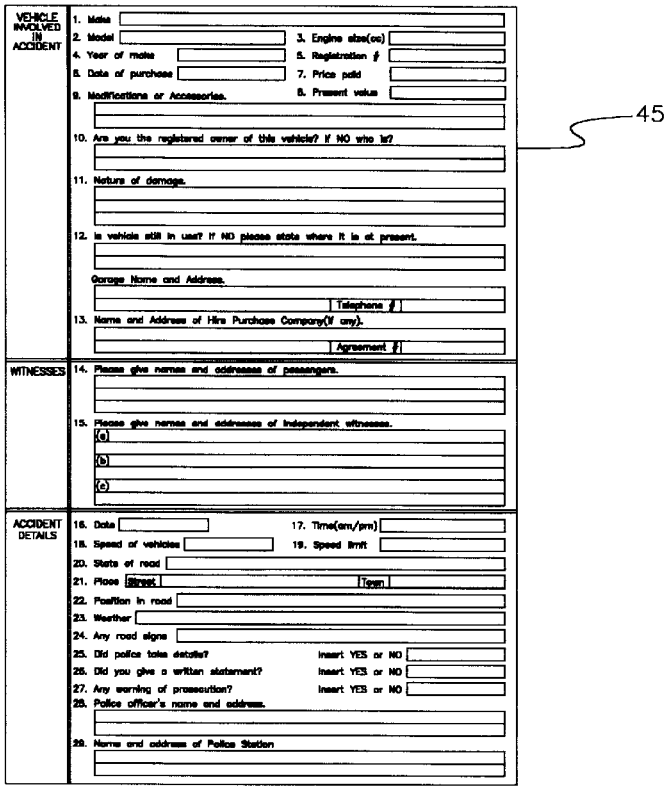

| | |
|---|---|
| VEHICLE INVOLVED IN ACCIDENT | 1. Make<br>2. Model 3. Engine size(cc)<br>4. Year of make 5. Registration #<br>6. Date of purchase 7. Price paid<br>8. Present value<br>9. Modifications or Accessories.<br>10. Are you the registered owner of this vehicle? If NO who is?<br>11. Nature of damage.<br>12. Is vehicle still in use? If NO please state where it is at present.<br>Garage Name and Address.<br>Telephone #<br>13. Name and Address of Hire Purchase Company(If any).<br>Agreement # |
| WITNESSES | 14. Please give names and addresses of passengers.<br>15. Please give names and addresses of independent witnesses.<br>(a)<br>(b)<br>(c) |
| ACCIDENT DETAILS | 16. Date 17. Time(am/pm)<br>18. Speed of vehicles 19. Speed limit<br>20. State of road<br>21. Place Street Town<br>22. Position in road<br>23. Weather<br>24. Any road signs<br>25. Did police take details? Insert YES or NO<br>26. Did you give a written statement? Insert YES or NO<br>27. Any warning of prosecution? Insert YES or NO<br>28. Police officer's name and address.<br>29. Name and address of Police Station |

45

Fig. 4

ACCIDENT REPORT KIT

BACKGROUND OF THE INVENTION

1. Field of the Invention

The present invention relates to accident report kits and more particularly pertains to a new accident report kit for providing accessories that may be used to record the details of a traffic accident in a single case.

2. Description of the Prior Art

The use of accident report kits is known in the prior art. More specifically, accident report kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,861,305; U.S. Pat. No. 5,306,973; U.S. Patent No. Des. 376,475; U.S. Pat. No. 2,550,870; U.S. Pat. No. 2,076,683; and U.S. Pat. No. 3,741,382.

While these devices fulfill their respective, particular objectives and requirements, the aforementioned patents do not disclose a new accident report kit. The inventive device includes a carrying case with a main portion and a tray portion. The main portion of the carrying case has spaced apart front and back walls, a bottom wall, and a pair of spaced apart side walls. The main portion has a top edge along the front, back and side walls defining a top opening into the main portion. The carrying case has a top flap substantially covering the top opening of the main portion. The main portion of the carrying case has a plurality of generally rectangular divider panels therein forming a plurality of compartments. The tray portion of the carrying case has a back panel and a perimeter lip extending around the back panel of the tray portion to define a tray space therein. The perimeter lip of the tray portion is pivotally coupled to the back wall of the main portion adjacent a side wall of the main portion.

In these respects, the accident report kit according to the present invention substantially departs from the conventional concepts and designs of the prior art, and in so doing provides an apparatus primarily developed for the purpose of providing accessories that may be used to record the details of a traffic accident in a single case.

SUMMARY OF THE INVENTION

In view of the foregoing disadvantages inherent in the known types of accident report kits now present in the prior art, the present invention provides a new accident report kit construction wherein the same can be utilized for providing accessories that may be used to record the details of a traffic accident in a single case.

The general purpose of the present invention, which will be described subsequently in greater detail, is to provide a new accident report kit apparatus and method which has many of the advantages of the accident report kits mentioned heretofore and many novel features that result in a new accident report kit which is not anticipated, rendered obvious, suggested, or even implied by any of the prior art accident report kits, either alone or in any combination thereof.

To attain this, the present invention generally comprises a carrying case with a main portion and a tray portion. The main portion of the carrying case has spaced apart front and back walls, a bottom wall, and a pair of spaced apart side walls. The main portion has a top edge along the front, back and side walls defining a top opening into the main portion. The carrying case has a top flap substantially covering the top opening of the main portion. The main portion of the carrying case has a plurality of generally rectangular divider panels therein forming a plurality of compartments. The tray portion of the carrying case has a back panel and a perimeter lip extending around the back panel of the tray portion to define a tray space therein. The perimeter lip of the tray portion is pivotally coupled to the back wall of the main portion adjacent a side wall of the main portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new accident report kit apparatus and method which has many of the advantages of the accident report kits mentioned heretofore and many novel features that result in a new accident report kit which is not anticipated, rendered obvious, suggested, or even implied by any of the prior art accident report kits, either alone or in any combination thereof.

It is another object of the present invention to provide a new accident report kit which may be easily and efficiently manufactured and marketed.

It is a further object of the present invention to provide a new accident report kit which is of a durable and reliable construction.

An even further object of the present invention is to provide a new accident report kit which is susceptible of a low cost of manufacture with regard to both materials and labor, and which accordingly is then susceptible of low prices of sale to the consuming public, thereby making such accident report kit economically available to the buying public.

Still yet another object of the present invention is to provide a new accident report kit which provides in the apparatuses and methods of the prior art some of the advantages thereof, while simultaneously overcoming some of the disadvantages normally associated therewith.

Still another object of the present invention is to provide a new accident report kit for providing accessories that may be used to record the details of a traffic accident in a single case.

Yet another object of the present invention is to provide a new accident report kit which includes a carrying case with a main portion and a tray portion. The main portion of the carrying case has spaced apart front and back walls, a bottom wall, and a pair of spaced apart side walls. The main portion has a top edge along the front, back and side walls defining a top opening into the main portion. The carrying case has a top flap substantially covering the top opening of the main portion. The main portion of the carrying case has a plurality of generally rectangular divider panels therein forming a plurality of compartments. The tray portion of the carrying case has a back panel and a perimeter lip extending around the back panel of the tray portion to define a tray space therein. The perimeter lip of the tray portion is pivotally coupled to the back wall of the main portion adjacent a side wall of the main portion.

Still yet another object of the present invention is to provide a new accident report kit that may be stored in a vehicle so that it is easily obtainable and ready to use if the vehicle is involved in a accident, particularly a traffic accident, or the driver is a witness to a traffic accident.

Even still another object of the present invention is to provide a new accident report kit that has a flashlight light source so that the kit may be used in low level lighting conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the present invention with the tray portion opened.

FIG. 4 is a schematic top side view of a sheet of the note pad of the present invention.

DESCRIPTION OF THE PREFERRED EMBODIMENT

Figure 1:
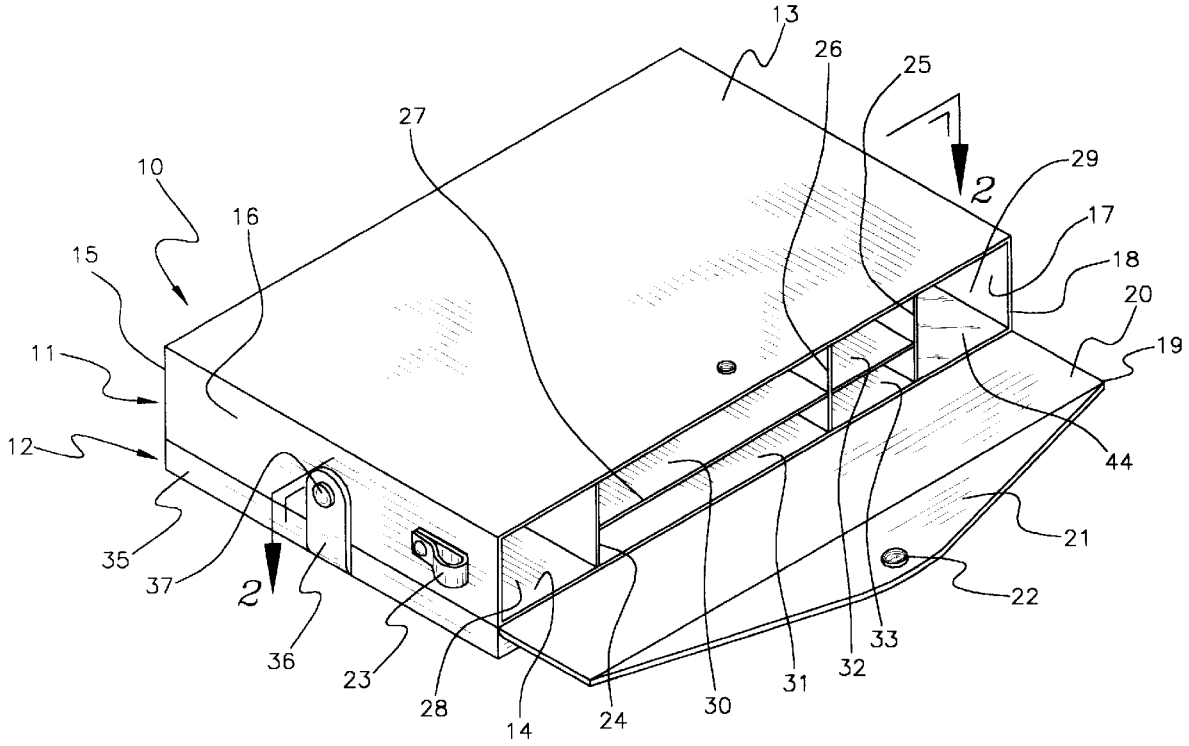
FIG. 1 is a schematic perspective view of a new accident report kit according to the present invention.
Figure 2:
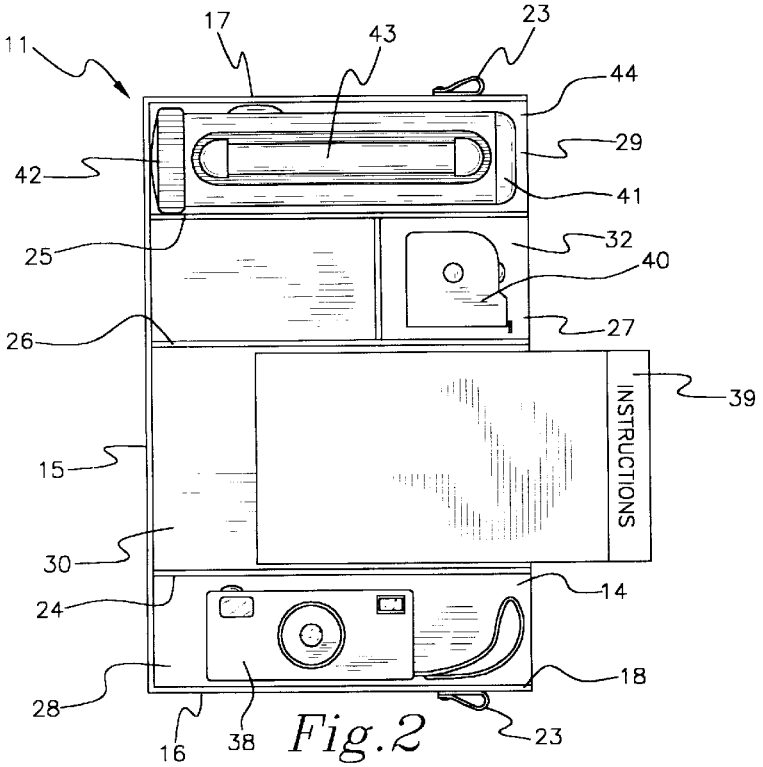
FIG. 2 is a schematic cross sectional view of the present invention taken from line 2—2 of FIG. 1.

With reference now to the drawings, and in particular to FIGS. 1 through 4 thereof, a new accident report kit embodying the principles and concepts of the present invention will be described.

As best illustrated in FIGS. 1 through 4, the accident report kit generally comprises a carrying case 10 with a main portion 11 and a tray portion 12. The main portion 11 of the carrying case 10 has spaced apart front and back walls 13,14, a bottom wall 15, and a pair of spaced apart side walls 16,17. The main portion 11 has a top edge 18 along the front, back and side walls 13,14,16,17 defining a top opening into the main portion 11. The carrying case 10 has a top flap 19 substantially covering the top opening of the main portion 11. The main portion 11 of the carrying case 10 has a plurality of generally rectangular divider panels 24,25,26,27 therein forming a plurality of compartments 28,29,30,31,32, 33. The tray portion 12 of the carrying case 10 has a back panel 34 and a perimeter lip 35 extending around the back panel 34 of the tray portion 12 to define a tray space therein. The perimeter lip 35 of the tray portion 12 is pivotally coupled to the back wall 14 of the main portion 11 adjacent a side wall of the main portion 11.

In closer detail, the accident report kit comprises a carrying case 10 with a generally rectangular box-shaped outer configuration and having a main portion 11 and a tray portion 12. The main portion 11 of the carrying case 10 has spaced apart generally rectangular front and back walls 13,14, a generally rectangular bottom wall 15, and a pair of spaced apart generally rectangular side walls 16,17. The bottom wall 15 and the side walls 16,17 of the main portion 11 are extended between the front and back walls 13,14 of the main portion 11. The bottom wall 15 of the main portion 11 is also extended between the side walls 16,17 of the main portion 11. The main portion 11 has a generally rectangular top edge 18 along the front, back and side walls defining a generally rectangular top opening into the main portion 11. The front and back walls 13,14 of the main portion 11 generally lie in generally parallel planes to one another. The side walls 16,17 of the main portion 11 generally lie in generally parallel planes top one another generally perpendicular to the front and back walls 13,14 of the main portion 11. The bottom wall 15 and the top edge 18 of the main portion 11 generally lie in generally parallel planes to one another generally perpendicular to the front, back, and side walls of the main portion.

The carrying case 10 has a top flap 19 substantially covering the top opening of the main portion. The top flap 19 has a generally rectangular covering portion 20 and a generally triangular lifting portion 21 pivotally coupled together. The covering portion 20 of the top flap 19 substantially covers the top opening of the main portion 11. The covering portion 20 of the top flap 19 is pivotally coupled to the back wall 14 of the main portion 11 along the upper edge of the main portion 11. The lifting portion 21 of the top flap 19 is detachably attached to the front wall 13 of the main portion 11. Ideally, a snap fastener 22 detachably attaches the lifting portion 21 of the top flap 19 to the front wall 13 of the main portion 11 for providing a quick and easy means of securing the top flap 19 over the top opening of the main portion 11.

Preferably, each of the side walls 16,17 of the main portion 11 has a tab 23 thereon designed for detachably attaching a carrying strap to the side walls of the main portion for carrying the carrying case 10 on the shoulder of a user.

The main portion 11 of the carrying case 10 has a plurality of generally rectangular divider panels therein forming dividing the interior of the main portion 11 a plurality of compartments in the main portion 11. The plurality of divider panels includes three spaced apart side divider panels 24,25,26. Each of side divider panels has a length extending between the bottom wall 15 and the top opening of the main portion 11 and a width extending between the front and back walls 13,14 of the main portion 11. The side divider panels preferably generally lie in parallel planes to one another generally parallel to the side walls 16,17 of the main portion 11. A first of the side divider panels 24 is positioned towards a first of the side walls 16 of the main portion 11. A second of the side divider panels 25 is positioned towards a second of the side wall 17 of the main portion 11. A third of the side divider panels 26 is interposed between the first and second side divider panels 24,25.

The first side divider panel 24 is spaced apart a distance from the first side wall 16 of the main portion 11. The second side divider panel 25 is spaced apart a distance from the second side wall 17 of the main portion 11. Preferably, the distance between the first side divider panel 24 and the first side wall 16 is about equal to the distance between the second side divider panel 25 and the second side wall 17. The third side divider panel 26 is spaced apart from the first side divider panel 24 a first distance. The third side divider panel 26 is spaced apart from the second side divider panel 25 a second distance. Preferably, the first distance of the third side divider panel is greater than the second distance of third side divider panel such that the third side divider panel is closer to the second side divider panel 25 than to the first side divider panel 24. Ideally, the first distance of the third side divider panel 26 is at least two-times greater than the second distance of third side divider panel.

The plurality of divider panels also includes a generally rectangular middle divider panel 27 extending between the first and second side divider panels 24,25 through the third side divider panel 26. The middle divider panel 27 generally lie in a plane generally parallel to the front and back walls 13,14 of the main portion 11. The middle divider panel 27 is about equally spaced between the front and back walls 13,14 of the main portion 11.

The first side wall 16 and the first side divider panel 24 define a first compartment 28 designed for holding a camera 38 therein for use in taking photos of the accident scene. The second side wall 17 and the second side divider panel 25 define a second compartment 29 designed for holding a flashlight 41 therein. The first and third side divider panels 24,26 and the middle divider panel 27 define third and fourth compartments 30,31. The third compartment 30 is designed for holding a sketch pad 39 therein. The fourth compartment 31 is designed for holding vehicle registration and insurance information therein. The second and third side divider panels 25,26 and the middle divider panel 27 define fifth and sixth compartments 32,33. The fifth compartment 32 is designed for holding a retractable measuring tape 40 therein. The sixth compartment 33 is designed for holding chalk therein for use marking road surfaces.

The tray portion 12 of the carrying case 10 has a generally rectangular back panel 34 and a generally rectangular perimeter lip 35 extending around the back panel 34 of the tray portion 12 to define a generally rectangular tray space designed for receiving a generally rectangular note pad 45 or tablet therein. The perimeter lip 35 of the tray portion 12 is pivotally coupled to the back wall 14 of the main portion 11 adjacent the second side wall 17 of the main portion 11. The perimeter lip 35 of the tray portion 12 has a flexible attachment strap 36 detachably attached to the first side wall 16 such that the tray space is substantially covered by the back wall 14 of the main portion 11. Ideally, a snap fastener 37 detachably attaches the attachment strap 36 of the perimeter lip 35 to the first side wall 16 of the main portion 11.

A camera 38 is provided in the first compartment 28 for use in taking photos of the scene of the accident. Preferably the camera 38 is a disposable type camera. A sketch pad 39 is provided in the third compartment 30. The sketch pad 39 preferably includes an instruction sheet with instructions for a user to follow after an accident has occurred. In use, the sketch pad 39 is designed for permitting a user to sketch diagrams and notes relating to the accident thereon. A retractable measuring tape 40 is provided in the fifth compartment 32. At least one stick of chalk is provided in the sixth compartment 33 for use in marking road surfaces after an accident.

A note pad 45 is provided in the tray space. The note pad 45 has plurality of sheets each with a questionnaire thereon with a plurality of boxes for filling in information relating to the accident including information concerning the vehicles involved in the accident, information concerning witnesses to the accident, and information concerning the details of the accident. Ideally, the sheets of the note pad 45 are duplicating sheets either carbonless duplicating sheets or sheets that may be duplicated with carbon sheet inserts.

A writing instrument 46 such as a pen or a pencil is also provided in the tray space for use in writing on the sketch pad 39 and the note pad 45.

A flashlight 41 is provided in the second compartment 29. The flashlight 41 has a generally rectangular box-shape outer configuration and has a first light source 42 at an end of the flashlight 41 and a second light source 43 at a side of the flashlight 41. The outer configuration of the flashlight 41 preferably substantially fills the second compartment 29 to prevent movement of the flashlight 41 in the second compartment 29 during transport of the carrying case 10.

The back wall 14 of the main portion 11 has a generally rectangular generally transparent window region 44 adjacent the second compartment 29 to permit passage of light from the second compartment 29 through the generally transparent window region 44 to the tray space. The second light source 43 of the flashlight 41 is positioned adjacent the generally transparent window to permit the shining of light from the second light source 43 through the generally transparent window. This allows a user writing on the note pad on the back panel to see the note pad in low light conditions with the light from the second light source of the flashlight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accident report kit, comprising:

a carrying case having a main portion and a tray portion said main portion of said carrying case having spaced apart front and back walls, a bottom wall, and a pair of spaced apart side walls;

said main portion having a top edge along said front, back and side walls defining a top opening into said main portion;

said carrying case having a top flap substantially covering said top opening of said main portion;

said main portion of said carrying case having a plurality of generally rectangular divider panels therein forming a plurality of compartments in said main portion;

said tray portion of said carrying case having a back panel and a perimeter lip extending around said back panel of said tray portion to define a tray space therein;

said perimeter lip of said tray portion being pivotally coupled to said back wall of said main portion adjacent a side wall of said main portion;

wherein said plurality of divider panels includes three spaced apart side divider panels, each of side divider panels having a length extending between said bottom wall and said top opening of said main portion and a width extending between said front and back walls of said main portion, wherein a first of said side divider panels is positioned towards a first of said side walls of said main portion, a second of said side divider panels is positioned towards a second of said side walls of said main portion, and a third of said side divider panels is interposed between said first and second side divider panels;

wherein said plurality of divider panels includes a middle divider panel extending between said first and second side divider panels through said third side divider panel;

wherein said first side wall and said first side divider define a first compartment adapted for holding a camera therein, wherein said second side wall and said second side divider define a second compartment adapted for holding a flashlight therein, wherein said first and third side divider panels and said middle divider panel define third and fourth compartments, said third compartment being adapted for holding a sketch pad therein, said fourth compartment being adapted for holding vehicle registration and insurance information therein, and wherein said second and third side divider panels and said middle divider panel define fifth and sixth compartments, fifth compartment being adapted for holding a retractable measuring tape therein, said sixth compartment being adapted for holding chalk therein;

a flashlight being provided in said second compartment;

wherein said flashlight has a generally rectangular box-shape outer configuration and has a first light source at an end of said flashlight and a second light source at a side of said flashlight; and wherein said back wall of said main portion has a generally rectangular generally transparent window region adjacent said second compartment to permit passage of light from said second compartment through said generally transparent window region to said tray space, said second light source of said flashlight being positioned adjacent said generally transparent window to permit the shining of light from said second light source through said generally transparent window.

2. The accident report kit of claim 1, wherein said front and back walls of said main portion generally lie in generally parallel planes to one another, wherein said side walls of said main portion generally lie in generally parallel planes to one another generally perpendicular to said front and back walls of said main portion, and wherein said bottom wall and said top edge of said main portion generally lie in generally parallel planes to one another generally perpendicular to said front, back, and side walls of said main portion.

3. The accident report kit of claim 1, wherein said top flap has a covering portion and a lifting portion pivotally coupled together, wherein said covering portion of said top flap substantially covers said top opening of said main portion, said covering portion of said top flap being pivotally coupled to said back wall of said main portion along said upper edge of said main portion, and wherein said lifting portion of said top flap is detachably attached to said front wall of said main portion.

4. The accident report kit of claim 3, wherein a snap fastener detachably attaches said lifting portion of said top flap to said front wall of said main portion.

5. The accident report kit of claim 1, wherein said side divider panels generally lie in parallel planes to one another generally parallel to said side walls of said main portion.

6. The accident report kit of claim 1, wherein said middle divider panel generally lies in a plane generally parallel to said front and back walls of said main portion.

7. The accident report kit of claim 6, wherein said middle divider panel is about equally spaced between said front and back walls of said main portion.

8. The accident report kit of claim 1, wherein said first side divider panel is spaced apart a distance from said first side wall of said main portion, said second side divider panel is spaced apart a distance from said second side wall of said main portion, and wherein said distance between said first side divider panel and said first side wall is about equal to said distance between said second side divider panel and said second side wall.

9. The accident report kit of claim 8, wherein said third side divider panel is spaced apart from said first side divider panel a first distance, said third side divider panel being spaced apart from said second side divider panel a second distance, wherein said first distance of said third side divider panel is greater than said second distance of third side divider panel such that said third side divider panel is closer to said second side divider panel than to said first side divider panel.

10. The accident report kit of claim 9, wherein said first distance of said third side divider panel is at least two-times greater than said second distance of third side divider panel.

11. The accident report kit of claim 1, further comprising a camera being provided in said first compartment, a sketch pad being provided in said third compartment, a measuring tape being provided in said fifth compartment, and at least one stick of chalk being provided in said sixth compartment.

12. The accident report kit of claim 1, wherein said outer configuration of said flashlight substantially fills said second compartment.

13. An accident report kit, comprising:

a carrying case having a generally rectangular box-shaped outer configuration and having a main portion and a tray portion;

said main portion of said carrying case having spaced apart generally rectangular front and back walls, a generally rectangular bottom wall, and a pair of spaced apart generally rectangular side walls, said bottom wall and said side walls of said main portion being extended between said front and back walls of said main portion, said bottom wall of said main portion being extended between said side walls of said main portion;

said main portion having a generally rectangular top edge along said front, back and side walls defining a generally rectangular top opening into said main portion;

said front and back walls of said main portion generally lying in generally parallel planes to one another, said side walls of said main portion generally lying in generally parallel planes top one another generally perpendicular to said front and back walls of said main portion, said bottom wall and said top edge of said main portion generally lying in generally parallel planes to one another generally perpendicular to said front, back, and side walls of said main portion;

said carrying case having a top flap substantially covering said top opening of said main portion, said top flap having a generally rectangular covering portion and a generally triangular lifting portion pivotally coupled together;

said covering portion of said top flap substantially covering said top opening of said main portion, said covering portion of said top flap being coupled to said back wall of said main portion along said upper edge of said main portion;

said lifting portion of said top flap being detachably attached to said front wall of said main portion wherein a snap fastener detachably attaches said lifting portion of said top flap to said front wall of said main portion;

said main portion of said carrying case having a plurality of generally rectangular divider panels therein forming a plurality of compartments in said main portion;

said plurality of divider panels including three spaced apart side divider panels, each of side divider panels having a length extending between said bottom wall and said top opening of said main portion and a width extending between said front and back walls of said main portion;

said side divider panels generally lying in parallel planes to one another generally parallel to said side walls of said main portion;

a first of said side divider panels being positioned towards a first of said side walls of said main portion, a second of said side divider panels being positioned towards a second of said side wall of said main portion, a third of said side divider panels being interposed between said first and second side divider panels;

said first side divider panel being spaced apart a distance from said first side wall of said main portion, said second side divider panel being spaced apart a distance from said second side wall of said main portion, wherein said distance between said first side divider panel and said first side wall is about equal to said distance between said second side divider panel and said second side wall;

said third side divider panel being spaced apart from said first side divider panel a first distance, said third side divider panel being spaced apart from said second side divider panel a second distance, wherein said first distance of said third side divider panel is greater than said second distance of said third side divider panel such that said third side divider panel is closer to said second side divider panel than to said first side divider panel, wherein said first distance of said third side divider panel is at least two-times greater than said second distance of said third side divider panel;

said plurality of divider panels including a generally rectangular middle divider panel extending between said first and second side divider panels through said third side divider panel;

said middle divider panel generally lying in a plane generally parallel to said front and back walls of said main portion, said middle divider panel being about equally spaced between said front and back walls of said main portion;

said first side wall and said first side divider panel defining a first compartment adapted for holding a camera therein;

said second side wall and said second side divider panel defining a second compartment adapted for holding a flashlight therein;

said first and third side divider panels and said middle divider panel defining third and fourth compartments, said third compartment being adapted for holding a sketch pad therein, said fourth compartment being adapted for holding vehicle registration and insurance information therein;

said second and third side divider panels and said middle divider panel defining fifth and sixth compartments, fifth compartment being adapted for holding a retractable measuring tape therein, said sixth compartment being adapted for holding chalk therein;

said tray portion of said carrying case having a generally rectangular back panel and a generally rectangular perimeter lip extending around said back panel of said tray portion to defining a generally rectangular tray space adapted for receiving a generally rectangular note pad therein;

said perimeter lip of said tray portion being pivotally coupled to said back wall of said main portion adjacent said second side wall of said main portion;

said perimeter lip of said tray portion having a flexible attachment strap being detachably attached to said first side wall such that said tray space is substantially covered by said back wall of said main portion, wherein a snap fastener detachably attaches said attachment strap of said perimeter lip to said first side wall of said main portion;

a camera being provided in said first compartment;

a sketch pad being provided in said third compartment, said sketch pad including an instruction sheet having instructions for a user to follow after an accident has occurred;

a retractable measuring tape being provided in said fifth compartment;

at least one stick of chalk being provided in said sixth compartment;

a flashlight being provided in said second compartment, said flashlight having a generally rectangular box-shape outer configuration and having a first light source at an end of said flashlight and a second light source at a side of said flashlight;

said outer configuration of said flashlight substantially filling said second compartment;

said back wall of said main portion having a generally rectangular generally transparent window region adjacent said second compartment to permit passage of light from said second compartment through said generally transparent window region to said tray space;

said second light source of said flashlight being positioned adjacent said generally transparent window to permit the shining of light from said second light source through said generally transparent window;

a note pad being provided in said tray space, said note pad having plurality of sheets each having a questionnaire thereon with a plurality of boxes for filling in information relating to the accident including information concerning the vehicles involved in the accident, information concerning witnesses to the accident, and information concerning the details of the accident; and a writing instrument being provided in said tray space.

14. An accident report kit, comprising:

a carrying case having a main portion and a tray portion;

said main portion of said carrying case having spaced apart front and back walls, a bottom wall, and a pair of spaced apart side walls;

said main portion having a top edge along said front, back and side walls defining a top opening into said main portion;

said carrying case having a top flap substantially covering said top opening of said main portion;

said main portion of said carrying case having a plurality of generally rectangular divider panels therein forming a plurality of compartments in said main portion;

said tray portion of said carrying case having a back panel and a perimeter lip extending around said back panel of said tray portion to define a tray space therein;

said perimeter lip of said tray portion being pivotally coupled to said back wall of said main portion adjacent a side wall of said main portion;

a flashlight being provided in a compartment in said main portion;

wherein said flashlight has a generally rectangular box-shape outer configuration and has a first light source at an end of said flashlight and a second light source at a side of said flashlight; and wherein said back wall of said main portion has a generally rectangular generally transparent window region adjacent said compartment to permit passage of light from said compartment through said generally transparent window region to said tray space, said second light source of said flashlight being positioned adjacent said generally transparent window region to permit the shining of light from said second light source through said generally transparent window.

15. The accident report kit of claim 14, wherein said front and back walls of said main portion generally lie in generally parallel planes to one another, wherein said side walls of said main portion generally lie in generally parallel planes to one another generally perpendicular to said front and back walls of said main portion, and wherein said bottom wall and said top edge of said main portion generally lie in generally parallel planes to one another generally perpendicular to said front, back, and side walls of said main portion.

16. The accident report kit of claim 14, wherein said top flap has a covering portion and a lifting portion pivotally coupled together, wherein said covering portion of said top flap substantially covers said top opening of said main portion, said covering portion of said top flap being pivotally coupled to said back wall of said main portion along said upper edge of said main portion, and wherein said lifting portion of said top flap is detachably attached to said front wall of said main portion.

17. The accident report kit of claim 16, wherein a snap fastener detachably attaches said lifting portion of said top flap to said front wall of said main portion.

18. The accident report kit of claim 14, wherein said plurality of divider panels includes three spaced apart side divider panels, each of side divider panels having a length extending between said bottom wall and said top opening of said main portion and a width extending between said front and back walls of said main portion, wherein a first of said side divider panels is positioned towards a first of said side walls of said main portion, a second of said side divider panels is positioned towards a second of said side walls of said main portion, and a third of said side divider panels is interposed between said first and second side divider panels.

19. The accident report kit of claim 18, wherein said plurality of divider panels includes a middle divider panel extending between said first and second side divider panels through said third side divider panel.

* * * * *